7/9/85 OR 4,528,559

United States Patent [19]

Freeman

[11] Patent Number: 4,528,559

[45] **Date of Patent: * Jul. 9, 1985**

[54] SEISMIC ACTUATION SYSTEM

[76] Inventor: Albert J. Freeman, 58 Milland Dr., Mill Valley, Calif. 94941

[ * ] Notice: The portion of the term of this patent subsequent to Nov. 4, 2000 has been disclaimed.

[21] Appl. No.: 510,466

[22] Filed: Jul. 1, 1983

Related U.S. Application Data

[63] Continuation-in-part of Ser. No. 251,585, Apr. 6, 1981, Pat. No. 4,408,196.

[51] Int. Cl.[3] ..... G08B 21/00

[52] U.S. Cl. ..... 340/690; 200/61.45 R; 200/61.53; 200/DIG. 8; 200/DIG. 20; 307/117

[58] Field of Search ..... 340/566, 690, 540, 65; 200/61.45 R, 61.53, DIG. 8, DIG. 20; 307/117

[56] References Cited

U.S. PATENT DOCUMENTS 2,288,683 7/1942 Clancy .
3,267,739 8/1966 Epps et al. .
3,269,685 8/1966 Wallace .
3,485,973 12/1969 Kaiser .
3,550,717 12/1970 Doty, Jr. .
3,611,345 10/1971 Pintell .
3,638,501 2/1972 Prachar .
3,733,448 5/1973 Brady .
3,763,484 10/1973 Byers .
3,779,262 12/1973 Manning et al. .
3,878,858 4/1975 Yamada .
3,927,286 12/1975 Fohl .
4,117,450 9/1978 Lavalley et al. .
4,124,841 11/1978 Kettunen .
4,305,058 12/1981 Baumann .
4,390,922 6/1983 Pelliccia ..... 307/117
4,408,196 10/1983 Freeman .

*Primary Examiner*—Glen R. Swann, III
*Attorney, Agent, or Firm*—Townsend and Townsend

[57] ABSTRACT

A seismic actuation system incorporating a plurality of motion sensors. The motion sensors included a housing in which a weight is supported for slidable movement along a single direction within the housing. The sensors are mounted to a horizontally disposed enclosure. The sensors are arranged so that the directions of travel of the weights within the enclosures are uniformly arranged so that vibration of sufficient magnitude in the horizontal plane will cause one or more of the weights to move. By adjusting the mass of the weights, the sensitivity of the sensors can be adjusted. When a seismic event of sufficient magnitude occurs, the weight becomes displaced from a central position within its housing and moves to one or the other end of the housing to activate the contacts. Activating the contacts completes a circuit so that one or more warnings, such as bells, lights, or spoken words, are produced or one or more safety devices are actuated.

18 Claims, 9 Drawing Figures

SEISMIC ACTUATION SYSTEM

This is a continuation-in-part of U.S. patent application Ser. No. 251,585, filed Apr. 6, 1981, now U.S. Pat. No. 4,408,196 issued Oct. 4, 1983.

BACKGROUND OF THE INVENTION

The need for alarm systems in the home has become accepted and is reflected by the recent increase in the number of smoke detectors being sold. Other security systems such as heat detectors, gas detectors, and intrusion monitors have also become more commonplace, especially in commercial establishments. However, an earthquake is one hazard from which occupants of a building are largely unprotected. An earthquake alarm system would be useful in that it would warn the occupant of the seismic event so that they could quickly seek protection before the occurrence of aftershocks.

Inertia type switches sensitive to motion can be used to detect earthquakes and are quite well known. Many use balls in detents so that upon movement the balls can be vibrated free to complete an electrical circuit. See, for example, U.S. Pat. Nos. 3,733,448; 3,878,858; 3,927,286; and 4,124,841. Another type uses balls which roll in transversely placed tracks so that the balls contact switches at the end of the tracks when the track is caused to tilt. Such a device is shown in U.S. Pat. No. 3,269,685. An inertia type switch having a cylindrical inertia mass which slides over a surface is shown in U.S. Pat. No. 3,779,262.

SUMMARY OF THE INVENTION

A seismic actuation system incorporating a plurality of motion sensors is disclosed. The motion sensors each included a housing in which a weight is supported for sliding movement along a single direction within the housing. The sensors are mounted to the base of a horizontally disposed enclosure. The sensors are arranged in a starburst pattern so the directions of travel of the weights within the enclosures extend in many different directions. Vibration in any direction in the horizontal plane can cause one or more of the weights of the sensors to move if the vibration is of great enough magnitude.

When a seismic event of sufficient magnitude occurs, one or more of the weights become displaced from a central position within its housing and moves to an end of the housing to engage a contact. Engagement with any one contact completes a circuit to activate one or more warning devices. Completion of the circuit can also be used to actuate other devices, such as a relay switch for disconnecting electricity to the dwelling or a solenoid valve for sealing a gas line.

The provision of a plurality of direction sensitive motion sensors mounted to a single enclosure provides a redundancy of sensors for an increased margin of safety for the user. By using a number of sensors arranged to cover various directions of vibrations, if one sensor fails to operate properly, the sensors having the same or similar angular orientation provide back-up for increased safety.

The sensitivity of the actuation system is easily adjusted by changing the mass of the slidable weights. Because a number of sensors are used, the sensitivity of sensors disposed in certain directions can be different from those in other directions if desired.

Since the actuation system can be used with a number of different types of warning devices, an alarm system can be created which is tailored to the particular environment. For example, in a home where small children are present, a warning device producing spoken words can be used. The device could be programmed to tell the children what was happening and instruct them as to what they should do. Parents could run through test drills with their children so that in the case of an actual earthquake, they will be prepared to listen to the instructions of the warning device and proceed accordingly.

Other features and advantages of the present invention will appear from the following description in which the preferred embodiments have been set forth in detail in conjunction with the accompanying drawings.

DETAILED DESCRIPTION OF THE PREFERRED EMBODIMENTS

Figure 1:
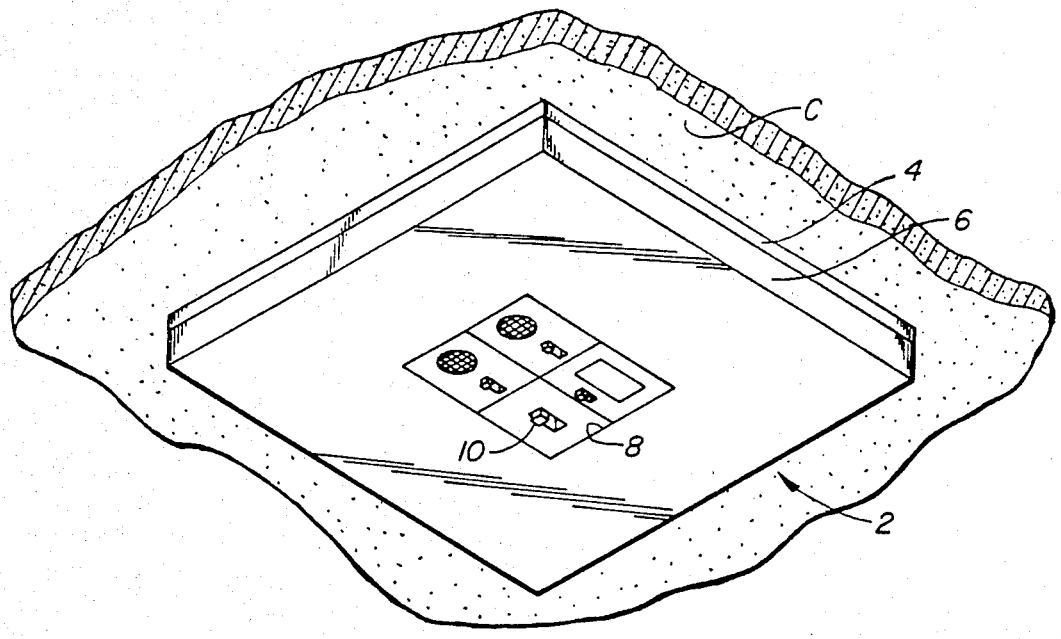
FIG. 1 is a perspective view of a seismic actuation system made according to the present invention mounted to a ceiling.

Turning now to FIG. 1, the seismic actuation system 2 of the present invention includes generally a base 4 attached to a ceiling C and over which a cover 6 is attached. The cover includes a central aperture 8 through which a power switch 10 and a number of warning devices are visible.

Figure 2:
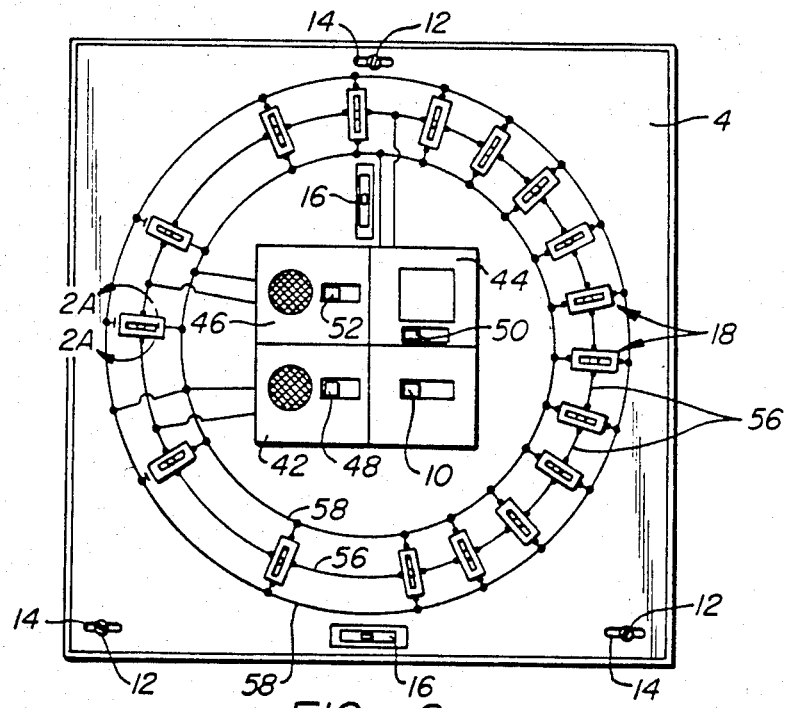
FIG. 2 is a bottom view of the system of FIG. 1 with the cover removed.

As seen at FIG. 2, base 4 is mounted to the ceiling by three screws 12. The screws pass through complementary slots 14 formed in a triangular pattern in base 4. Two levels 16 are attached to base 4 and are aligned between pairs of slots 14. These allow the user to accurately position the base in a horizontal attitude on the ceiling.

Mounted in a circular or starburst pattern around the center of the base are a number of motion sensors 18.

Figure 2A:
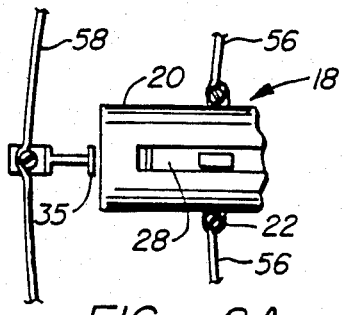
FIG. 2A is an enlarged view of taken along lines 2A—2A on FIG. 2.
Figure 4A:
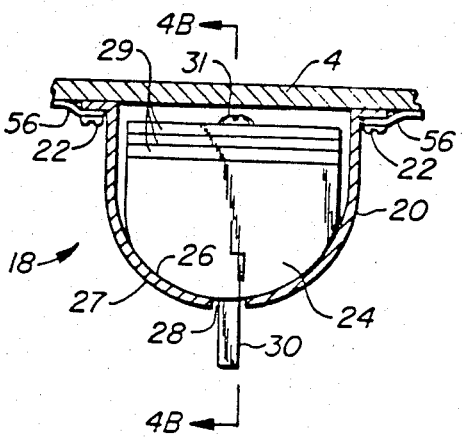
FIG. 4A is a cross-sectional end view of a cylindrical sensor.
Figure 4B:
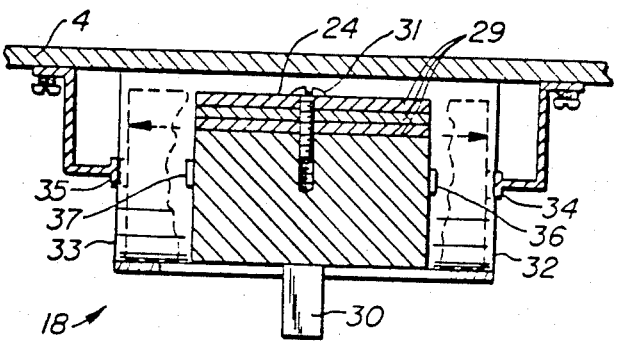
FIG. 4B is a cross-sectional side view of the sensor of FIG. 4A.

It can be seen that sensors 18 are arranged at about 15° intervals over approximately 180° on the right hand side of base 4 and at about 36° intervals over approximately 180° on the left hand side of base 4. The sensors are spaced to provide redundancy and thus an increased margin of safety by both close spacing and duplication of some angular orientations. These motion sensors, as seen best in FIGS. 2A, 4A and 4B, include an outer, electrically conductive arcuate shell 20 mounted to base 4 by screws 22. An electrically conductive slidable weight 24, having a cylindrical bottom 26, rides along a complementarily shaped lower portion 27 of shell 20. A longitudinal slot 28 is formed centrally within lower portion 27 and through which a tab 30, depending from weight 24, extends. This tab allows the user to center the weight within the shell.

Weight 24 includes a number of removable plates 29 secured by a screw 31 passing through appropriately sized holes in plates 29. Changing the number of plates 29 changes the mass of weight 24 and therefore modifies the sensitivity of sensor 18.

A pair of end contacts 34, 35 are mounted adjacent the longitudinal ends 32, 33 of shell 20. These contacts are positioned for engagement with appropriately placed contacts 36, 37 on weight 24 when the weight is moved adjacent ends 32 or 33 of shell 20, as shown in dashed lines in FIG. 4B. This can occur by the user using tab 30 or as the result of an earthquake. It should be noted that when contact 36 engages end contact 34 an electrical path is completed between contacts 34 and shell 20. Therefore, each motion sensor 18 acts as a motion sensitive, two-way switch 38 which is used to complete a circuit during an earthquake as is described in more detail below.

Figure 3:
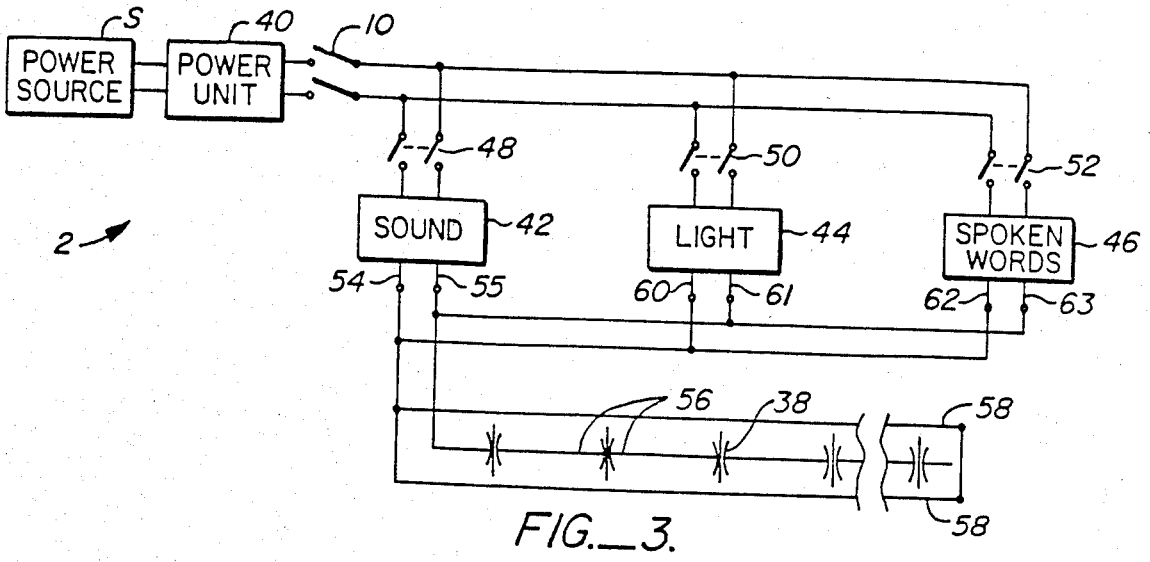
FIG. 3 is a schematic electrical diagram of the system of FIG. 1.

Turning now to FIG. 3 a schematic circuit diagram is presented representing the interconnection of various elements of seismic actuation system 2. Power switch 10 controls the supply of electricity from a power unit 40 to the balance of the circuit. Power unit 40 is connected to a power source S and includes a rechargeable battery kept charged by electricity from source S through a conventional battery charging circuit. It is desirable that power for system 2 is provided by a battery because during an earthquake electrical service may be disrupted. If desired, power unit 40 may be comprised solely of batteries so that access to a power source S, typically a household current outlet, would not be required. Of course the batteries would then have to be periodically replaced.

Electric power from power unit 40 is supplied through power switch 10 to a sound alarm unit 42, a light alarm unit 44 and a spoken word alarm unit 46 through respective alarm unit switches 48, 50, and 52. Sound alarm unit 42 is conventional in structure and emits a loud noise such as a ringing sound or a siren sound when inputs 54, 55 are electrically connected. This occurs when one or more switches 38 connect common conductors 56 to end conductors 58. Light alarm unit 50 produces a light signal and also provides auxiliary lighting to the room in the event of an earthquake. This is accomplished in the same manner as for alarm unit 42 by electrically connecting inputs 60, 61 using switches 38. Spoken word alarm unit 46 is activated in a manner similar to units 42 and 44 by electrically connecting inputs 62, 63. Alarm unit 46 can use various magnetic recording media, such as magnetic tape, or it can incorporate solid state word-formation devices similar to the language translators sold by Texas Instruments, Inc. of Dallas, Tex.

The particular structure of each alarm unit 42, 44 and 46 is conventional, forms no part of this invention and will therefore not be described in detail. However, it is preferable that they be capable of maintaining a complete alarm cycle even though the engagement of contacts 34, 35 with contacts 36, 37 is only momentary. For example, sound alarm unit 42 can be adapted to produce a signal for three minutes and then turn off if inputs 54, 55 are no longer closed at the end of the three minutes. Also, if alarm units 42 and 46 are used together, an interconnection which would first activate sound alarm 42 for a length of time, then allow unit 46 to produce its spoken message and then allow alarm 42 to recommence its alarm, is recommended.

Figure 5:
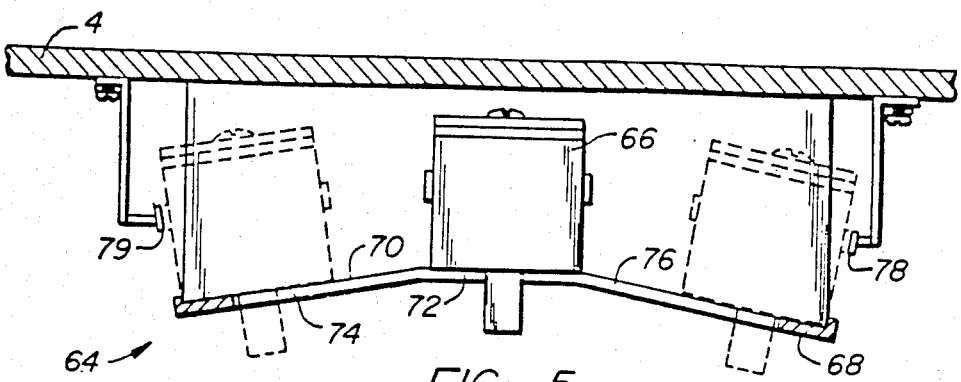
FIG. 5 is a cross-sectional side view of another embodiment of a sensor.

An alternative motion sensor 64, shown in FIG. 5, has a generally rectangular cross-sectional shape. A flat bottom, electrically conductive weight 66 is supported by a shell 68. Shell 68 has a bottom 70 including a generally horizontal central portion 72 and outwardly and downwardly sloping outer portions 74, 76. During an earthquake weight 66, if the seismic activity is of great enough magnitude, moves from portion 72 onto either portion 74 or 76 so that weight 66 completes an electric path between shell 68 and one of the two end contacts 78, 79. Other shapes and configurations for the motion sensors can be used as well.

Figure 6:
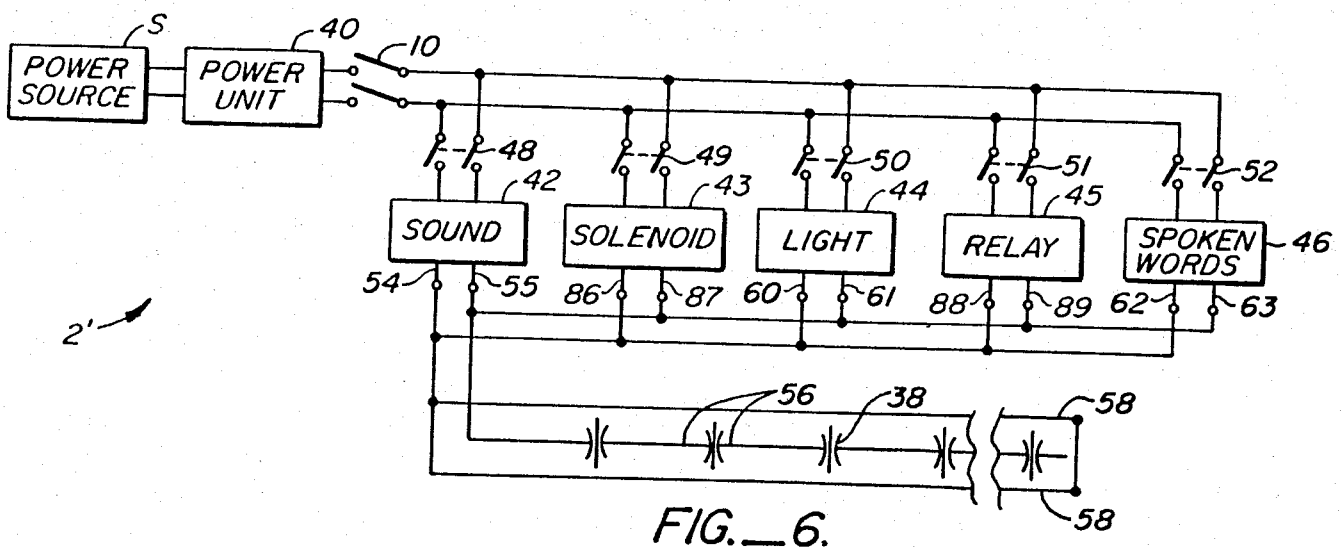
FIG. 6 is an alternative embodiment of the actuation system of FIG. 3 adding electrically actuated safety devices.
Figure 7:
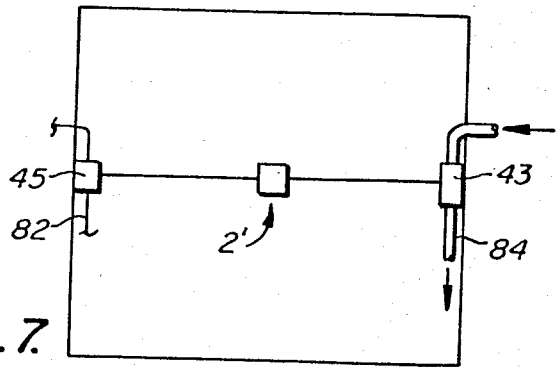
FIG. 7 is a plan view of a room using the actuation system of FIG. 6.

An alternative embodiment of seismic actuation system 2' is shown in FIG. 6. It is identical to that of FIG. 3 with the addition of a solenoid valve 43 and a relay switch 45. Valve 43 and switch 45 are connected to power unit 40 through switches 49, 51 respectively. With reference to FIG. 7, relay switch 45 is used to halt electricity through a main electricity line 82 while solenoid valve 43 seals a gas line 84 upon the occurrence of a seismic event. In this embodiment, system 2' acts not only as a seismic alarm but also as a seismic safety switch system. System 2' can also be used to actuate other switches or devices such as a camera or a security alarm. It can also be used to dial an emergency call, connect or disconnect computers or other equipment, lock bank drawers, turn lights on or off, or actuate or deactuate heating or cooling equipment. If desired system 2 can include only devices which do not produce alarm signals (as do alarm units 42, 44 and 46), but instead only electrically actuated devices devised to perform or initiate one or more functions such as those described above.

The operation of the seismic actuation system of the present invention will now be described briefly. The user first mounts base 4 to a ceiling C using screws 12 and levels 16 to ensure that base 4 is horizontal. If a rechargeable power unit 40 is used, system 2 is coupled to power source S. Power switch 10 is turned on and one or more of alarm units 42, 44 or 46, solenoid valve 43 or relay switch 45 are likewise turned on using switches 48, 50, 52, 49 and 51. During an earthquake of sufficient magnitude, regardless of the direction of horizontal motion of the building, one or more motion sensors 18 will activate. This occurs when a weight 24 moves to one of the longitudinal ends 32, 33 thus completing the electrical path between inputs 54 and 55, 60 and 61, 62 and 63, 86 and 87, and 88 and 89. Based upon which alarm units have been activated, an audible alarm from alarm unit 42, a visual signal from alarm unit 44 or a spoken word warning from alarm unit 46, or a combination thereof, will be produced. With actuation system 2' of FIG. 6, assuming switches 49 and 51 have been closed, solenoid valve 43 and relay switch 45 are actuated to seal gas line 84 and electrical line 82. After the seismic event the user can remove cover 6 to reset weights 24 within shells 20 to their central positions.

Modification and variation can be made to the disclosed embodiments without departing from the subject of the invention as defined in the following claims. For example, a greater or lesser number of motion sensors or electrically actuated devices can be used.

I claim:

1. A seismic actuation system comprising:

a plurality of motion sensors, each said sensor comprising:

a weight;

a housing for movably maintaining said weight within said housing parallel to an internal dimension, said weight including a depending positioning tab and said housing including a slot through which said tab extends to allow said weight to be positioned along said internal dimension; and electric contacts operable by said weights being displaced from a central position along said internal dimension;

means for adjustably mounting said motion sensors in a generally horizontal plane, said motion sensors being positioned at various angles to one another;

an electrically actuated device electrically coupled to said electric contacts; and means for powering said electrically actuated device when one or more of said weights have been displaced from said central position as a result of a seismic event.

2. The seismic system of claim 1 wherein said electrically actuated device includes a solenoid actuated valve.

3. The seismic system of claim 2 wherein said solenoid actuated valve is a gas line valve.

4. The seismic system of claim 1 wherein said weight slides on a surface in said housing along said internal dimension in response to movement of said housing of a sufficient magnitude.

5. The seismic system of claim 4 wherein said slidable weight and housing have complementarily shaped contacting arcuate sliding surfaces.

6. The seismic system of claim 1 wherein said weight weight includes removable weight plates so that the sensitivity of said system can be adjusted.

7. The seismic system of claim 1 wherein said plurality of motion sensors are mounted with their respective internal dimensions arranged transversely to one another.

8. The seismic system of claim 1 wherein said internal dimensions are uniformly arranged over a range of directions.

9. The seismic system of claim 8 wherein said range is approximately 180°.

10. The seismic system of claim 1 having a plurality of electrically actuated devices.

11. The seismic system of claim 1 wherein said electrically actuated device powering means includes a battery.

12. The seismic system of claim 11 wherein said battery is a rechargeable battery.

13. The seismic system of claim 1 wherein said mounting means includes an enclosure to which said motion sensors are attached and horizontal level indicators attached to said enclosure.

14. The seismic system of claim 4 wherein said housing sliding surface includes a generally horizontal central portion and inclined portions extending down and away from said horizontal central portion.

15. A seismic actuation system comprising:

a plurality of motion sensors, said sensors comprising:

a weight having an adjustable mass so that the sensitivity of said alarm can be adjusted;

a housing having a surface on which said weight slides along a path in response to movement of said sensor generally parallel to said path, said weight and housing having complimentarily shaped contacting sliding surfaces, said housing sliding surface including a generally horizontal central portion and inclined portions extending down and away from said horizontal central portion; and electric contacts operable by said weight when said weight is displaced from a central position along said path;

an enclosure having a generally planar, horizontal mounting surface;

means for mounting said motion sensors to said mounting surface so that said sliding surfaces of said housing and weight of each said motion sensor are parallel to said mounting surface;

means for adjustably positioning said mounting surface to a horizontal position;

an electrically actuated device electrically coupled to said electric contacts for indicating when one or more of said weights have been displaced from respective central positions thereby engaging said contacts; and means for powering said electrically actuated device.

16. The seismic system of claim 15 wherein said housing sliding surface is curved.

17. The seismic system of claim 15 wherein said enclosure includes means for covering said motion sensors.

18. A seismic alarm comprising:

a plurality of motion sensors, said sensors comprising:

a weight having an adjustable mass so that the sensitivity of said alarm can be adjusted;

a housing having a surface on which said weight slides along a path in response to movement of said sensor generally parallel to said path, said weight and housing having complimentarily shaped contacting sliding surfaces;

said weight including a depending positioning tab and said housing including a slot through which the tab extends to allow the weight to be positioned along said housing sliding surface; and electric contacts operable by said weight when said weight is displaced from a central position along said path;

an enclosure having a generally planar, horizontal mounting surface;

means for mounting said motion sensors to said mounting surface so that said sliding surfaces of said housing and weight of each said motion sensor are parallel to said mounting surface;

means for adjustably positioning said mounting surface to a horizontal position;

an electrically actuated device coupled to said electric contacts for indicating when one or more of said weights have been displaced from respective central positions thereby engaging said contacts; and means for powering said electrically actuated device.

* * * * *